US009360805B2

(12) United States Patent
Yonemoto

(10) Patent No.: US 9,360,805 B2
(45) Date of Patent: Jun. 7, 2016

(54) INTERMEDIATE TRANSFER UNIT FOR STABLY CHARGING AND CLEANING

(71) Applicant: KYOCERA Document Solutions Inc., Osaka (JP)

(72) Inventor: Satoru Yonemoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/222,675

(22) Filed: Mar. 23, 2014

(65) Prior Publication Data

US 2014/0294432 A1 Oct. 2, 2014

(30) Foreign Application Priority Data

Mar. 26, 2013 (JP) ..... 2013-063321

(51) Int. Cl.
*G03G 15/16* (2006.01)
*G03G 21/00* (2006.01)

(52) U.S. Cl.
CPC ..... *G03G 15/161* (2013.01); *G03G 21/007* (2013.01); *G03G 2215/1661* (2013.01); *G03G 2221/0005* (2013.01)

(58) Field of Classification Search
CPC ..... G03G 2221/0005; G03G 2215/1661; G03G 15/161; G03G 15/168; G03G 21/007; G03G 21/0076
USPC ..... 399/101
See application file for complete search history.

(56) References Cited

U.S. PATENT DOCUMENTS

| | | | | |
|---|---|---|---|---|
| 5,678,143 | A * | 10/1997 | Nagahara et al. | 399/150 |
| 7,421,239 | B2 * | 9/2008 | Kimura et al. | 399/350 |
| 7,787,800 | B2 * | 8/2010 | Mori | 399/101 |
| 2006/0222424 | A1 * | 10/2006 | Facci et al. | 399/349 |
| 2009/0232530 | A1 * | 9/2009 | Saito et al. | 399/50 |
| 2010/0150601 | A1 * | 6/2010 | Sano et al. | 399/101 |
| 2010/0150602 | A1 * | 6/2010 | Sano et al. | 399/101 |
| 2010/0232824 | A1 * | 9/2010 | Shibuya et al. | 399/71 |
| 2011/0274474 | A1 * | 11/2011 | Arai et al. | 399/346 |
| 2013/0084095 | A1 * | 4/2013 | Meguro | 399/71 |
| 2013/0195528 | A1 * | 8/2013 | Noguchi et al. | 399/346 |

FOREIGN PATENT DOCUMENTS

| | | | |
|---|---|---|---|
| JP | H01-116377 | U | 8/1989 |
| JP | H04-074774 | U | 6/1992 |
| JP | H09-190087 | A | 7/1997 |
| JP | H10-073125 | A | 3/1998 |
| JP | 2004-117726 | A | 4/2004 |
| JP | 2011-095612 | A | 5/2011 |
| JP | 2012-032625 | A | 2/2012 |

* cited by examiner

*Primary Examiner* — Clayton E Laballe
*Assistant Examiner* — Trevor J Bervik
(74) *Attorney, Agent, or Firm* — James W. Judge

(57) ABSTRACT

An intermediate transfer unit includes an intermediate transfer belt, a plurality of rollers, a cleaning unit, a brush unit, and a pressing member. The brush unit is located at the outer circumferential surface part of the intermediate transfer belt in contact with the roller. The brush unit is located at upstream of a contacting part with the cleaning unit in a running direction of the intermediate transfer belt. The brush unit is configured to impart electric charge to the remnant toner by a contact friction with the outer circumferential surface of the intermediate transfer belt. The pressing member is configured to press the brush unit along a direction of contact/separation with respect to the outer circumferential surface of the intermediate transfer belt.

5 Claims, 9 Drawing Sheets

INTERMEDIATE TRANSFER UNIT FOR STABLY CHARGING AND CLEANING

CROSS-REFERENCE TO RELATED APPLICATION

This application is based upon, and claims the benefit of priority from, corresponding Japanese Patent Application No. 2013-063321 filed in the Japan Patent Office on Mar. 26, 2013, the entire contents of which are incorporated herein by reference.

BACKGROUND

Unless otherwise indicated herein, the description in this section is not prior art to the claims in this application and is not admitted to be prior art by inclusion in this section.

There is an image forming apparatus that includes image forming units of respective colors arranged side by side at positions facing an intermediate transfer belt. In this image forming apparatus, toner images with the respective colors are superimposed on the intermediate transfer belt to form a color image. The color image is transferred to a recording medium with a secondary transfer roller. Thus, an image is formed on the recording medium. This image forming apparatus includes a cleaning device that removes toner remaining on a circumferential surface of the intermediate transfer belt after transfer of the color image to the recording medium.

For example, there is a cleaning device that recovers the toner from the circumferential surface of the intermediate transfer belt by electrostatic adsorption. The cleaning device includes a sheet-shaped brush at upstream of a fur brush, which electrostatically attracts the toner from the intermediate transfer belt, to stabilize charging of the remnant toner. Thus, the remnant toner can be reliably recovered from the circumferential surface of the intermediate transfer belt. Further, there is provided a device that stabilizes a distance from a cleaning brush to a roller by supporting the cleaning brush to a bearing of the roller. The cleaning brush contacts the peripheral surface of the roller and recovers the remnant toner on the peripheral surface of the roller.

SUMMARY

An intermediate transfer unit according to an exemplary embodiment of the present disclosure includes an intermediate transfer belt, a plurality of rollers, a cleaning unit, a brush unit, and a pressing member. The intermediate transfer belt has an outer circumferential surface onto which a toner image is transferred from an image forming unit. The plurality of rollers around which the intermediate transfer belt is stretched is configured to cause the intermediate transfer belt to run endlessly. The cleaning unit is configured to contact an outer circumferential surface part of the intermediate transfer belt in a state where the intermediate transfer belt is in contact with any one of the rollers due to the stretching. The cleaning unit is configured to electrostatically adsorb and recover toner remaining on the outer circumferential surface. The brush unit is located at the outer circumferential surface part of the intermediate transfer belt in contact with the roller. The brush unit is located at upstream of a contacting part with the cleaning unit in a running direction of the intermediate transfer belt. The brush unit is configured to impart electric charge to the remnant toner by a contact friction with the outer circumferential surface of the intermediate transfer belt. The pressing member is configured to press the brush unit along a direction of contact/separation with respect to the outer circumferential surface of the intermediate transfer belt.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 6 illustrates a state where a brush member and a supporting member have moved from the state illustrated in FIG. 5 to a direction approaching an outer circumferential surface of the intermediate transfer belt;

FIG. 7 illustrates a state where the brush member and the supporting member have moved to a direction of pressing force by a pressing spring;

FIG. 8 illustrates a state where the brush member and the supporting member have moved to the inverse direction of the direction of the pressing force by the pressing spring.

DETAILED DESCRIPTION

Figure 1:
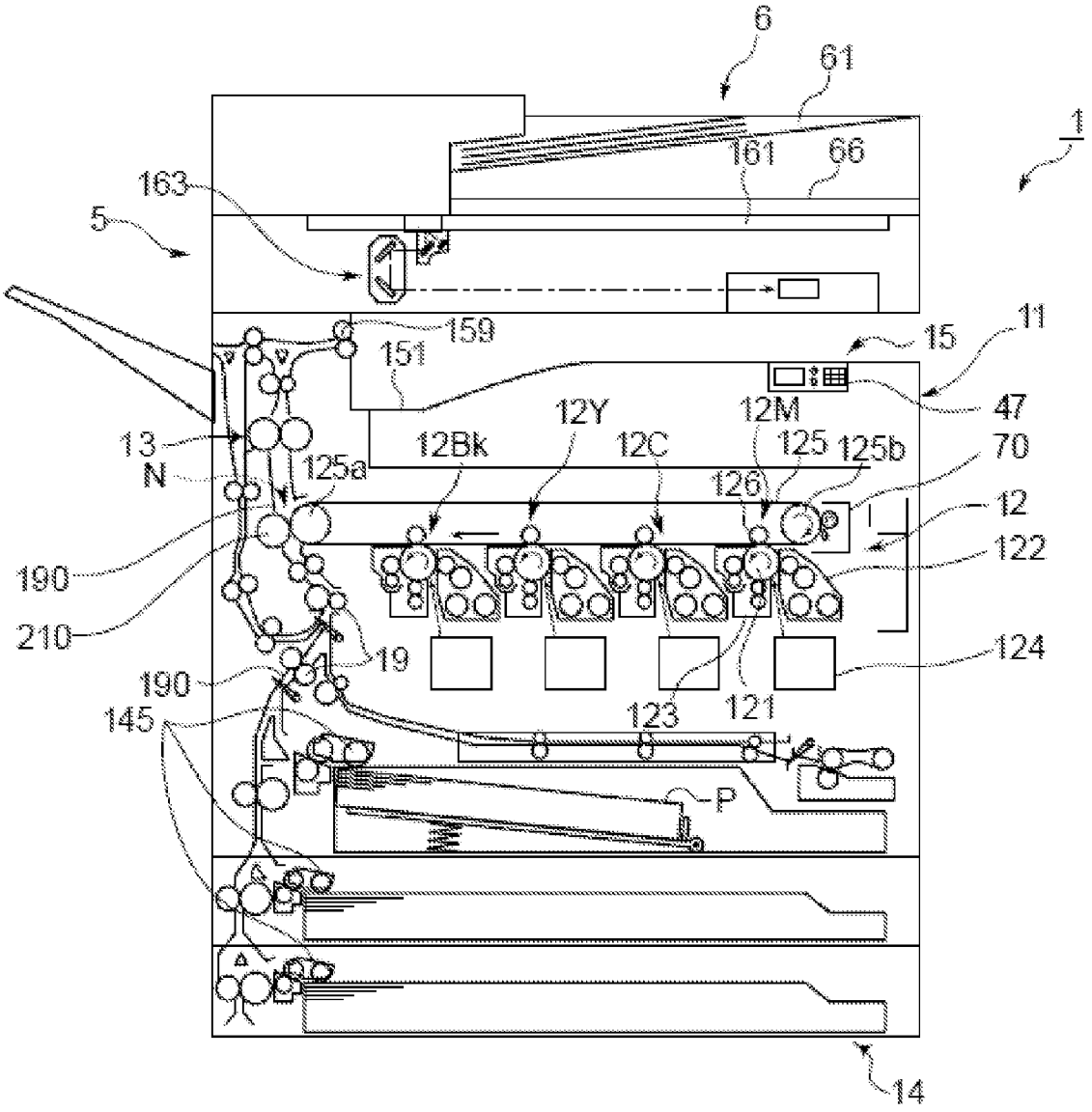
FIG. 1 is a front cross-sectional view illustrating a structure of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

An image forming apparatus according to one embodiment of the disclosure will now be described with reference to the accompanying drawings. However, the present disclosure is not limited to the embodiments described as examples here. In addition, for example, applications of the embodiment of the present disclosure and terms described here are not limited to those in the embodiments. FIG. 1 is a front cross-sectional view illustrating a structure of the image forming apparatus according to one embodiment of the disclosure.

An image forming apparatus 1 according to one embodiment of the disclosure is a multi-functional peripheral with a plurality of functions, for example, a copying function, a printer function, a scanner function, and a facsimile function. The image forming apparatus 1 includes, a manipulation unit 47, an image forming unit 12, a fixing unit 13, a paper sheet feeder 14, a document feeding unit 6, and an image reading unit 5, or a similar unit in an apparatus main body 11.

The manipulation unit 47 accepts instructions such as an image formation operation execution instruction and a document reading operation execution instruction from an operator on various operations and processes executable by the image forming apparatus 1.

In a document reading operation by the image forming apparatus 1, the image reading unit 5 optically reads a document fed by the document feeding unit 6 or an image of a document placed on a document placing glass 161, thus creating image data. The image data created by the image reading unit 5 is stored in a built-in HDD, a network-coupled computer, or a similar medium.

In an image formation operation by the image forming apparatus 1, the image forming unit 12 forms a toner image on a recording sheet P as a recording medium fed from the paper sheet feeder 14, based on the image data created by the document reading operation, the image data received from the network-connected computer, the image data stored in the built-in HDD, or similar data. The image forming unit 12 includes image forming units 12M, 12C, 12Y, and 12Bk. The image forming units 12M, 12C, 12Y, and 12Bk each have a photoreceptor drum 121, a developing equipment 122, a toner cartridge (not illustrated), a charging apparatus 123, an exposure apparatus 124, and a primary transfer roller 126. The developing equipment 122 supplies the photoreceptor drum 121 with toner. The toner cartridge houses toner.

For color printing, the image forming unit 12M for magenta, the image forming unit 12C for cyan, the image forming unit 12Y for yellow, and the image forming unit 12Bk for black of the image forming unit 12 each form a toner image on the photoreceptor drum 121 based on images formed of the respective color components constituting the image data through processes of charge, exposure, and development. Then, the primary transfer roller 126 causes the toner images to be transferred on an intermediate transfer belt 125 stretched by a drive roller 125*a* and a driven roller 125*b*.

An image carrying surface, to which the toner images are transferred, is set to the outer circumferential surface of the intermediate transfer belt 125. The intermediate transfer belt 125 is driven by the drive roller 125*a* with contacting the peripheral surface of the photoreceptor drum 121. The intermediate transfer belt 125 runs between the drive roller 125*a* and the driven roller 125*b* endlessly while synchronizing with each photoreceptor drum 121.

The toner images with the respective colors to be transferred on the intermediate transfer belt 125 are superimposed on the intermediate transfer belt 125 while the transfer timing is adjusted, thus forming a color toner image. A secondary transfer roller 210 causes the color toner image formed on the surface of the intermediate transfer belt 125 to be transferred on the recording sheet P conveyed from the paper sheet feeder 14 to a conveyance path 190 at a nip portion N between the secondary transfer roller 210 and the drive roller 125*a*, which sandwich the intermediate transfer belt 125. Thereafter, the fixing unit 13 causes the toner image on the recording sheet P to be fixed on the recording sheet P by thermocompression bonding. The color-image-formed recording sheet P on which the fixing process has been completed is discharged to a discharge tray 151.

A cleaning device 70 is provided at the intermediate transfer belt 125 part stretched by the driven roller 125*b*. The cleaning device 70 recovers toner remaining on the outer circumferential surface of the intermediate transfer belt 125.

The intermediate transfer belt 125, the primary transfer roller 126, the drive roller 125*a*, the driven roller 125*b*, and the cleaning device 70 are mounted to an intermediate transfer unit 50.

Figure 2:
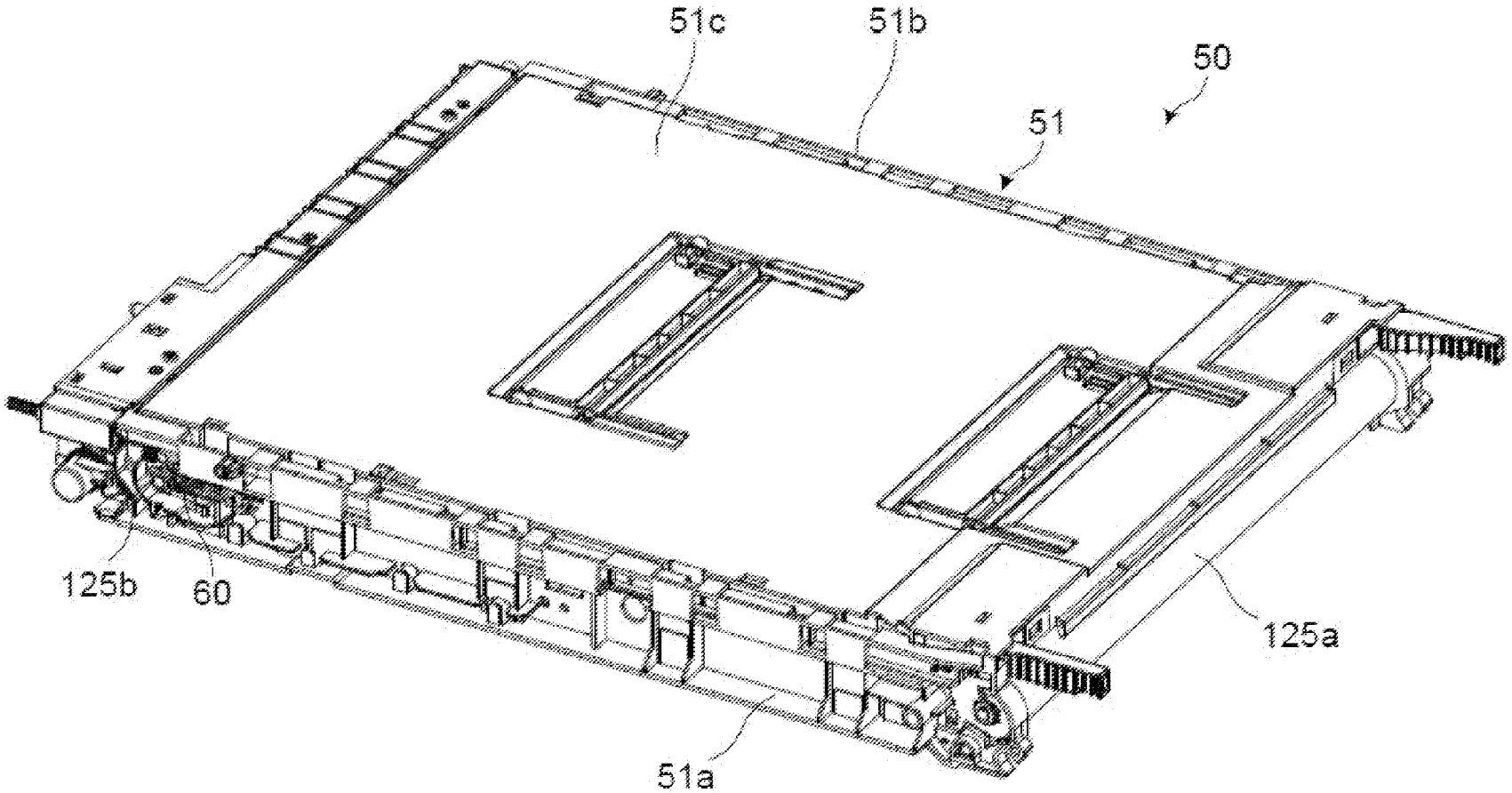
FIG. 2 is a perspective view illustrating an external appearance of an intermediate transfer unit.

Next, the intermediate transfer unit 50 will be described. FIG. 2 is a perspective view illustrating an external appearance of the intermediate transfer unit 50.

The intermediate transfer unit 50 is mounted to the upper side of the image forming unit 12 in the apparatus main body 11. As described above, the intermediate transfer unit 50 implements the intermediate transfer belt 125, the primary transfer roller 126, the drive roller 125*a*, the driven roller 125*b*, and the cleaning device 70.

The intermediate transfer unit 50 includes a casing 51. Each mechanism included by the intermediate transfer unit 50 is mounted to the casing 51. The casing 51 includes a top surface portion 51*c* and lateral surface portions 51*a* and 51*b* located at edge portions of the top surface portion 51*c*. The casing 51 has one end part, at which the drive roller 125*a* is rotatably supported, and the other end part, at which the driven roller 125*b* is supported.

This driven roller 125*b* includes a pressing spring (exemplary elastic member) 60. The pressing spring 60 presses the driven roller 125*b* in the direction of imparting tension to the intermediate transfer belt 125 stretched by the drive roller 125*a* and the driven roller 125*b*. The driven roller 125*b* is pivotally supported to the casing 51 so as to be movable in the directions of application of pressing force by the pressing spring 60 and a pressure against the pressing force.

The intermediate transfer belt 125 is covered with the casing 51 where the upper side and both lateral sides are formed of the top surface portion 51*c* and the lateral surface portions 51*a* and 51*b*, while being stretched between the drive roller 125*a* and the driven roller 125*b* thus supported. In FIG. 2, the lower portion of the intermediate transfer belt 125 is exposed from the casing 51. The image forming units for the respective colors are located below the exposed intermediate transfer belt 125 part, inside of the apparatus main body 11 to which the intermediate transfer unit 50 is installed.

Figure 3:
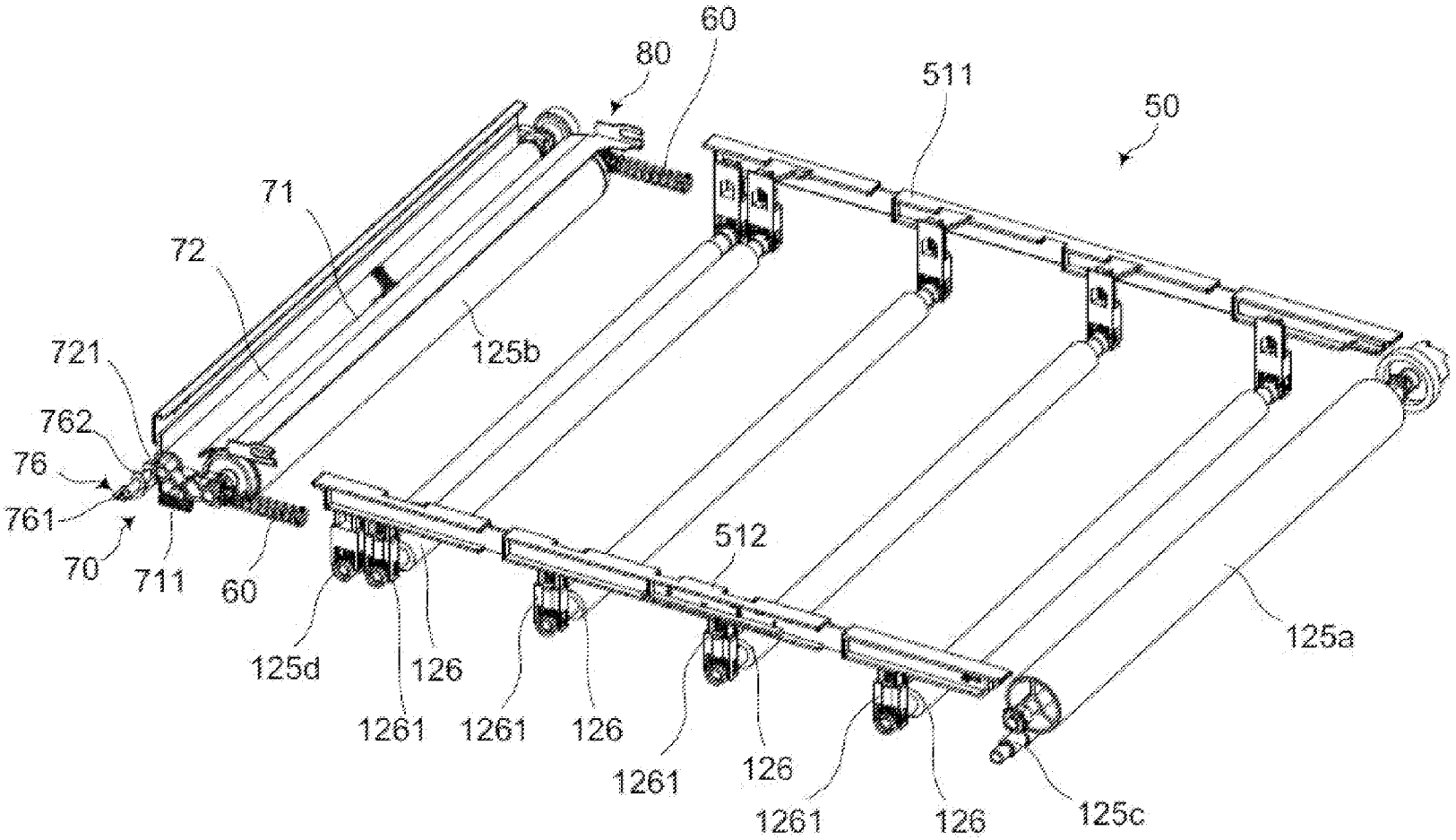
FIG. 3 is a perspective view illustrating the intermediate transfer unit in a state where a casing and an intermediate transfer belt are removed.
Figure 4:
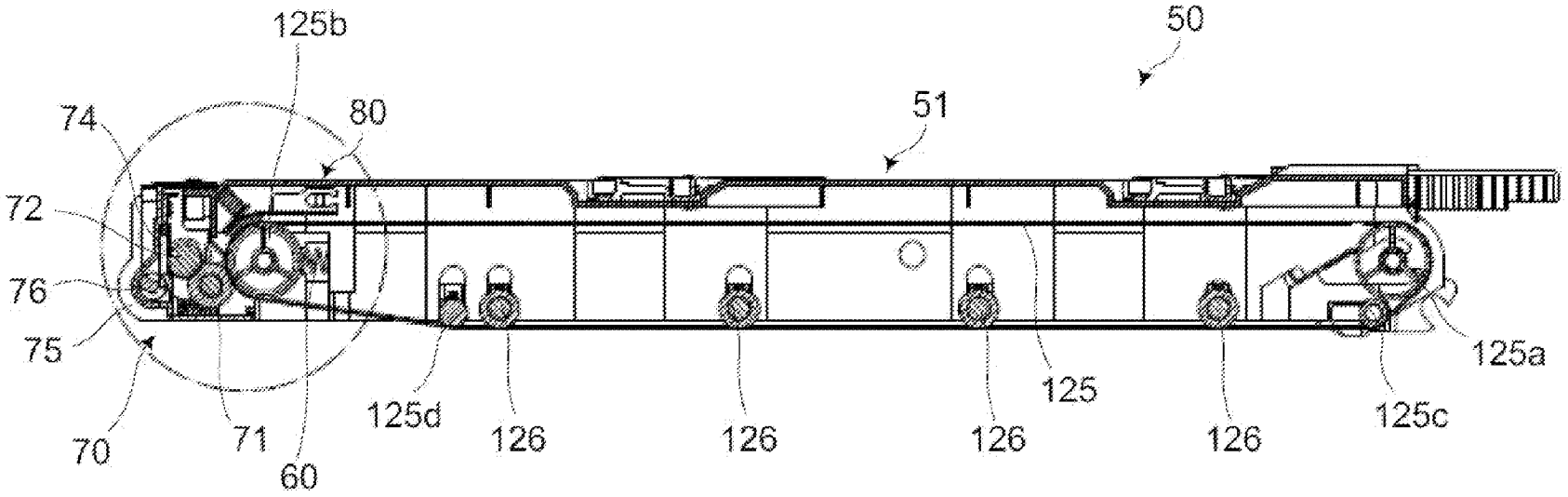
FIG. 4 is a cross-sectional side view of the intermediate transfer unit.
Figure 5:
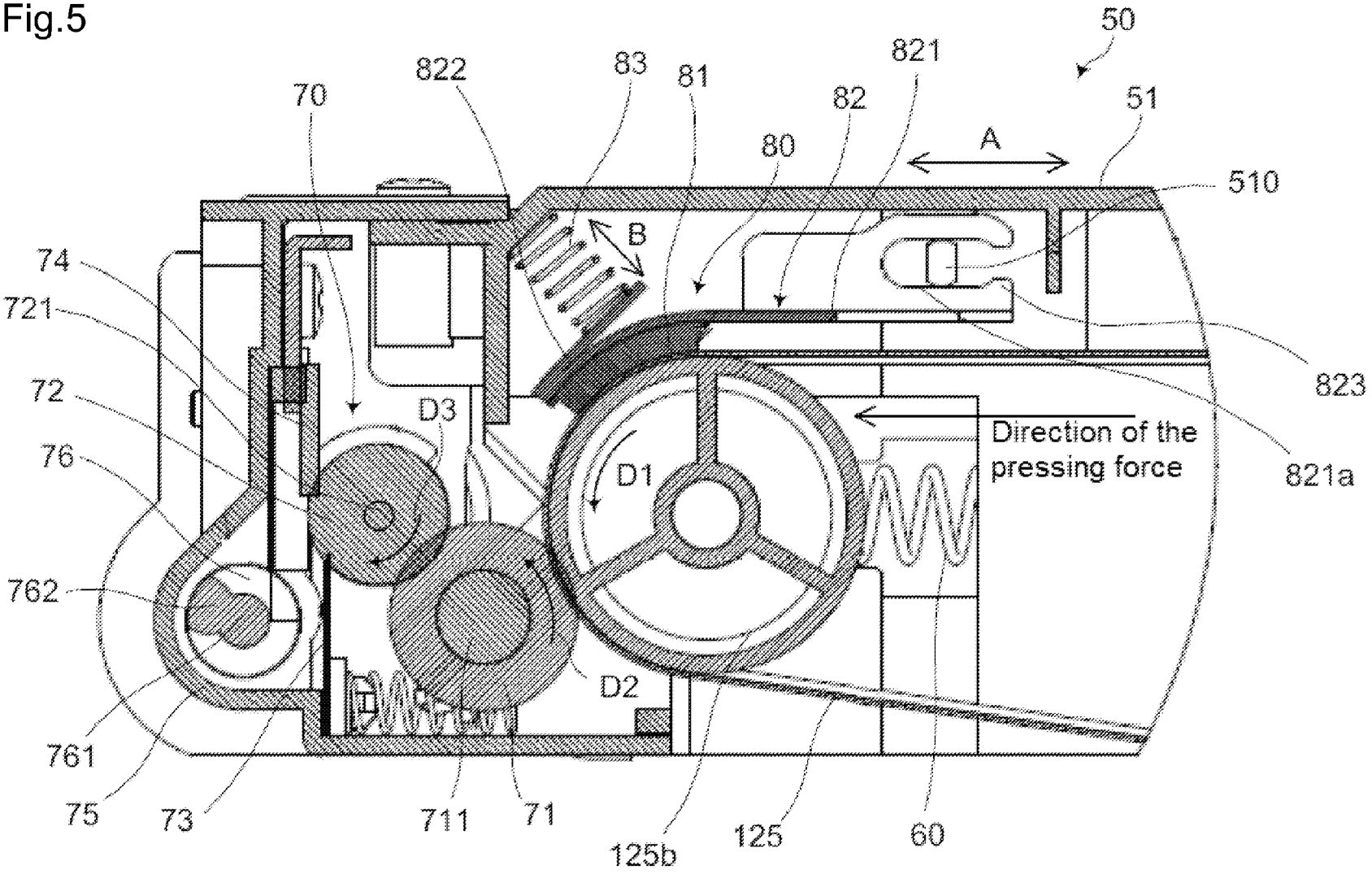
FIG. 5 is a cross-sectional side view illustrating mechanisms around a driven roller in the intermediate transfer unit.

Next, the internal constitution of the intermediate transfer unit 50 will be described. FIG. 3 is a perspective view illustrating the intermediate transfer unit 50 in a state where the casing 51 and the intermediate transfer belt 125 are removed. FIG. 4 is a cross-sectional side view of the intermediate transfer unit 50. FIG. 5 is a cross-sectional side view illustrating mechanisms around the driven roller 125*b* in the intermediate transfer unit 50.

The casing 51 of the intermediate transfer unit 50 internally includes tension rollers 125*c* and 125*d*, primary transfer rollers 126 with respective colors, the cleaning device (the cleaning unit) 70, and a brush unit 80 as well as the above-described intermediate transfer belt 125, drive roller 125*a*, and driven roller 125*b*. The primary transfer rollers 126 with respective colors are mounted to frames 511 and 512 extending in the running direction of the intermediate transfer belt 125 via a bearing 1261.

The cleaning device 70 contacts the outer circumferential surface part of the intermediate transfer belt 125 stretched by the driven roller 125*b* and recovers toner remaining on the outer circumferential surface by electrostatic adsorption.

The cleaning device 70 includes a fur brush 71, a recovery roller 72, a toner reception seal 73, a cleaning blade 74, a toner storage unit 75, and a toner conveyance screw 76.

The fur brush 71 contacts the outer circumferential surface of the intermediate transfer belt 125 stretched by the driven roller 125*b* and recovers toner remaining on the outer circumferential surface by electrostatic adsorption. The fur brush 71 is constituted, for example, by winding a nonwoven fabric formed of filament made of resin or a similar fabric around the whole circumference of a rotation shaft 711. The rotation shaft 711 of the fur brush 71 extends in the rotation shaft direction of the driven roller 125*b* and is pivotally supported to the casing 51. The fur brush 71 rotates around the rotation shaft 711 as the rotational center, in the circumferential velocity direction opposite (the arrow D2 direction indicated in FIG. 5) to the circumferential velocity direction (the arrow D1 direction indicated in FIG. 5) of the driven roller 125*b*.

The recovery roller 72 contacts the surface of the fur brush 71 and electrically recovers the toner recovered by the fur brush 71 from the fur brush 71. The recovery roller 72 includes a rotation shaft 721 that extends in the rotation shaft direction of the fur brush 71 and is pivotally supported to the casing 51. The recovery roller 72 rotates around the rotation shaft 721 as the rotational center, in the same circumferential velocity direction as the circumferential velocity direction (the arrow D3 direction indicated in FIG. 5) of the fur brush 71.

The toner reception seal 73 is constituted of a PET film, thermoplastic polyurethane, or a similar material. The toner reception seal 73 causes the toner attached to the surface of the recovery roller 72 to pass through at the position where the distal end portion of the toner reception seal 73 is opposed to the surface of the recovery roller 72. Meanwhile, the toner reception seal 73 contacts the recovery roller 72 at an appropriate pressure contact force to prevent the toner scraped off from the surface of the recovery roller 72 by the cleaning blade 74 from returning backward to the fur brush 71 side. The toner reception seal 73 is attached to the casing 51.

The cleaning blade 74 is formed of a flat plate-shaped member and extends in the rotation axis direction of the recovery roller 72. The cleaning blade 74 is attached to the casing 51 such that the distal end portion of the cleaning blade 74 in the side view illustrated in FIG. 5 contacts the surface of the recovery roller 72. The cleaning blade 74 scrapes off the toner recovered by the recovery roller 72 from the surface of the recovery roller 72. The scraped toner drops into and remains in the toner storage unit 75.

The toner storage unit 75 includes the toner conveyance screw 76. The toner conveyance screw 76 extends to the rotation shaft direction of the recovery roller 72 and includes a rotation shaft 761 pivotally supported to the casing 51. The rotation shaft 761 of the toner conveyance screw 76 is provided with a spiral patterned toner conveyance blade 762 at the peripheral surface. The toner conveyance blade 762 gathers the toner in the toner storage unit 75 to a discharge toner tank (not illustrated) located at a predetermined position in the rotation shaft 761 direction. Thus, the remnant toner on the outer circumferential surface of the intermediate transfer belt 125 is recovered.

Next, the brush unit 80 will be described. The brush unit 80 is a mechanism that imparts electric charges to the toner remnant (hereinafter referred to as remnant toner) on the outer circumferential surface of the intermediate transfer belt 125 even after the secondary transfer by contact friction with the outer circumferential surface of the intermediate transfer belt 125 part stretched by the driven roller 125*b*. The brush unit 80 includes a brush member 81, a supporting member 82, and a pressing member 83.

The brush member 81 is located at the outer circumferential surface of the intermediate transfer belt 125 part stretched by the driven roller 125*b*. The brush member 81 is located upstream of the outer circumferential surface part of the intermediate transfer belt 125 contacting the cleaning device 70 in the running direction of the intermediate transfer belt 125. The brush member 81 is located so as to contact the outer circumferential surface of the intermediate transfer belt 125 at this position. The brush member 81 is formed in a curved surface contour following the contour of the outer circumferential surface of the intermediate transfer belt 125 stretched by the driven roller 125*b*. Friction generated by the contact between the brush member 81 and the outer circumferential surface of the intermediate transfer belt 125 imparts electric charges to the remnant toner.

The supporting member 82 is a member for holding the brush member 81 and is made of synthetic resin, sheet metal, or a similar material. The supporting member 82 causes the brush member 81 to turn in a direction of contact/separation with respect to the outer circumferential surface of the intermediate transfer belt 125 part stretched by the driven roller 125*b*. The supporting member 82 includes a brush holder unit 821 and a spring mounting unit 822. The brush holder unit 821 is formed in a curved surface contour following the contour of the outer circumferential surface of the intermediate transfer belt 125 stretched by the driven roller 125*b*. The brush holder unit 821 includes the brush member 81 at the surface facing the outer circumferential surface of the intermediate transfer belt 125. The spring mounting unit 822 is located integrally with the brush holder unit 821 at the distal end portion of the brush holder unit 821. One end part of the pressing member 83 is attached to the spring mounting unit 822. The supporting member 82 is mounted to the casing 51. The supporting member 82 turns around a protrusion 510, which is formed in the casing 51, as the pivot.

The pressing member 83 is, for example, a pressing spring.

The pressing member 83 includes one end part, to which the spring mounting unit 822 is mounted, and the other end part, to which the inner wall part of the casing 51 opposed to the supporting member 82 is mounted. The pressing member 83 presses the supporting member 82 to the direction of contact/separation with respect to the outer circumferential surface of the intermediate transfer belt 125 stretched by the driven roller 125*b*. In the side view illustrated in FIG. 5, the above-described spring mounting unit 822 extends in the direction perpendicular to the direction of the pressing force by the pressing member 83. Thus, the spring mounting unit 822 receives the pressing force by the pressing member 83 with having the direction of the pressing force as the direction of contact/separation, thus ensuring transmission of the pressing force to the brush holder unit 821 and the brush member 81.

With this configuration, the brush member 81 contacts the outer circumferential surface of the intermediate transfer belt 125 part stretched by the driven roller 125*b* while being pressed against the intermediate transfer belt 125 by the pressing member 83 via the supporting member 82. That is, the brush member 81 contacts the outer circumferential surface of the intermediate transfer belt 125 part whose inner circumferential surface is supported by the driven roller 125*b*. The contact causes the brush member to generate friction with the outer circumferential surface of the intermediate transfer belt 125 during running of the intermediate transfer belt 125, thus electric charges are imparted to the remnant toner.

The supporting member 82 includes a slit-shaped opening 821*a* at the end, upstream side in the running direction of the intermediate transfer belt 125. The opening 821*a* extends in the direction that the pressing spring 60 presses the driven roller 125*b*. A clasp unit 823 is formed on the supporting member 82 to clasp the protrusion 510 with the opening 821*a*. The protrusion 510 is formed in an arc shape at the contact surface with the opening 821*a*. The supporting member 82 turns around the protrusion 510 as the rotational center by clasping the protrusion 510 with the clasp unit 823. The opening 821*a* has voids at the protrusion 510 in the directions of the pressing force side by the pressing spring 60 and the opposite direction side. In this state, an initial state of the supporting member 82 is configured such that the clasp unit 823 clasps the protrusion 510.

The opening 821*a* is formed in the slit shape extending in the direction of the pressing force by the pressing spring 60. Thus, the supporting member 82 and the brush member 81 freely move in the direction of the pressing force (the direction that the opening 821*a* extends, an arrow A direction illustrated in FIG. 5).

Thus, the supporting member 82 and the brush member 81 freely move both in the direction of contact/separation (the arrow B direction illustrated in FIG. 5) and the direction of the pressing force (the arrow A direction illustrated in FIG. 5).

Figure 6:
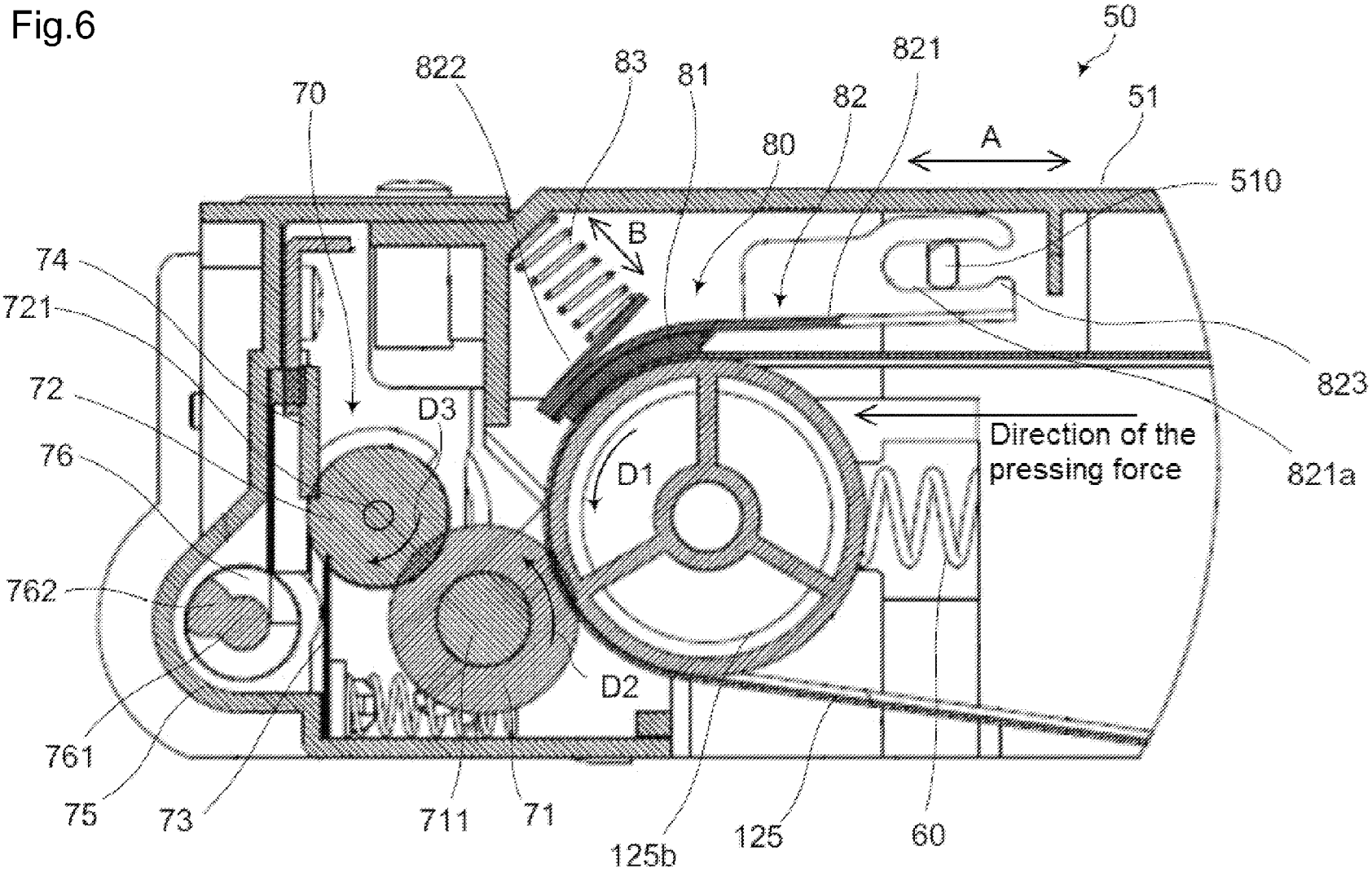
FIG. 6 is a cross-sectional side view illustrating the mechanisms around the driven roller in the intermediate transfer unit.
Figure 7:
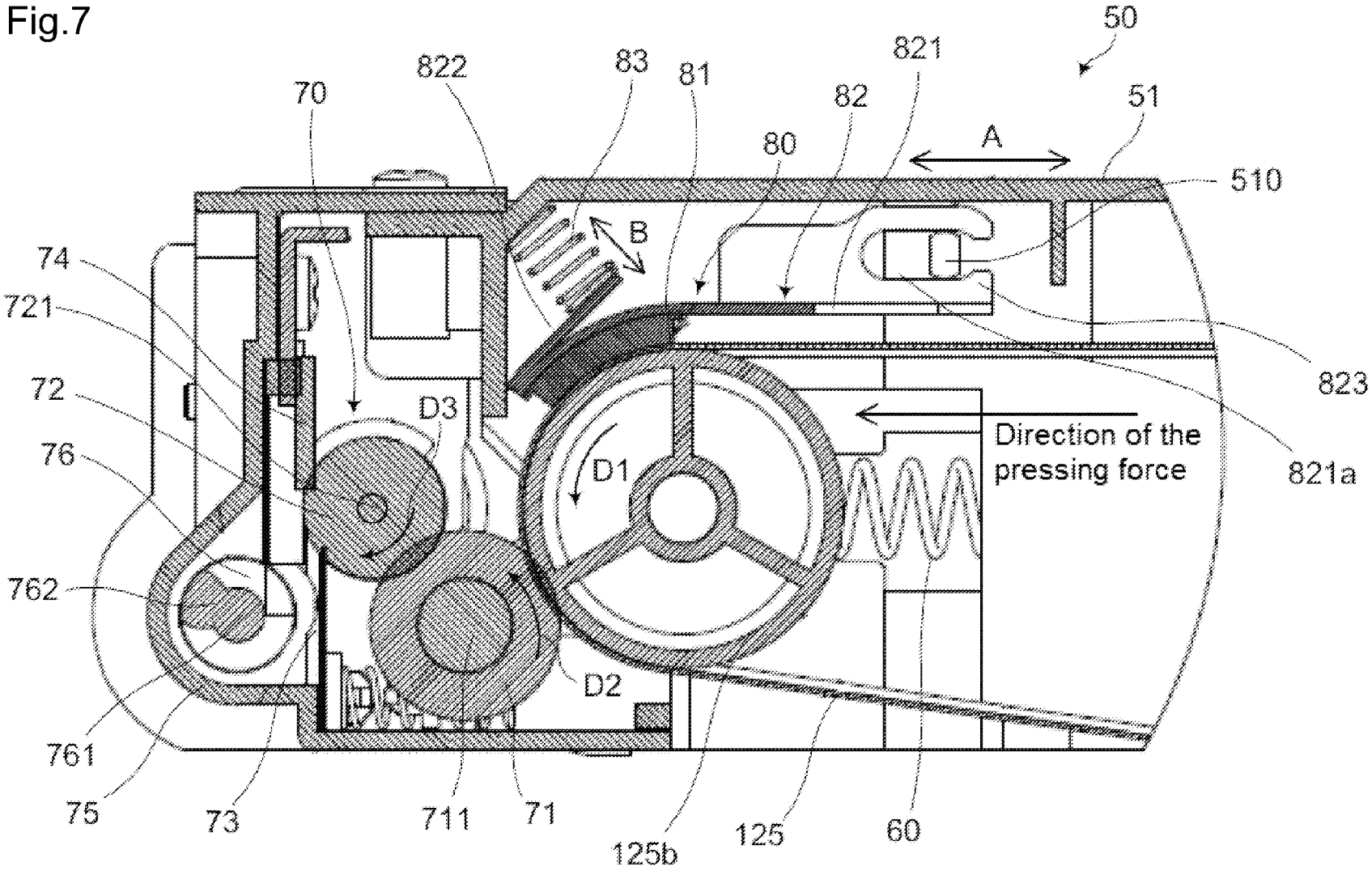
FIG. 7 is a cross-sectional side view illustrating the mechanisms around the driven roller in the intermediate transfer unit.
Figure 8:
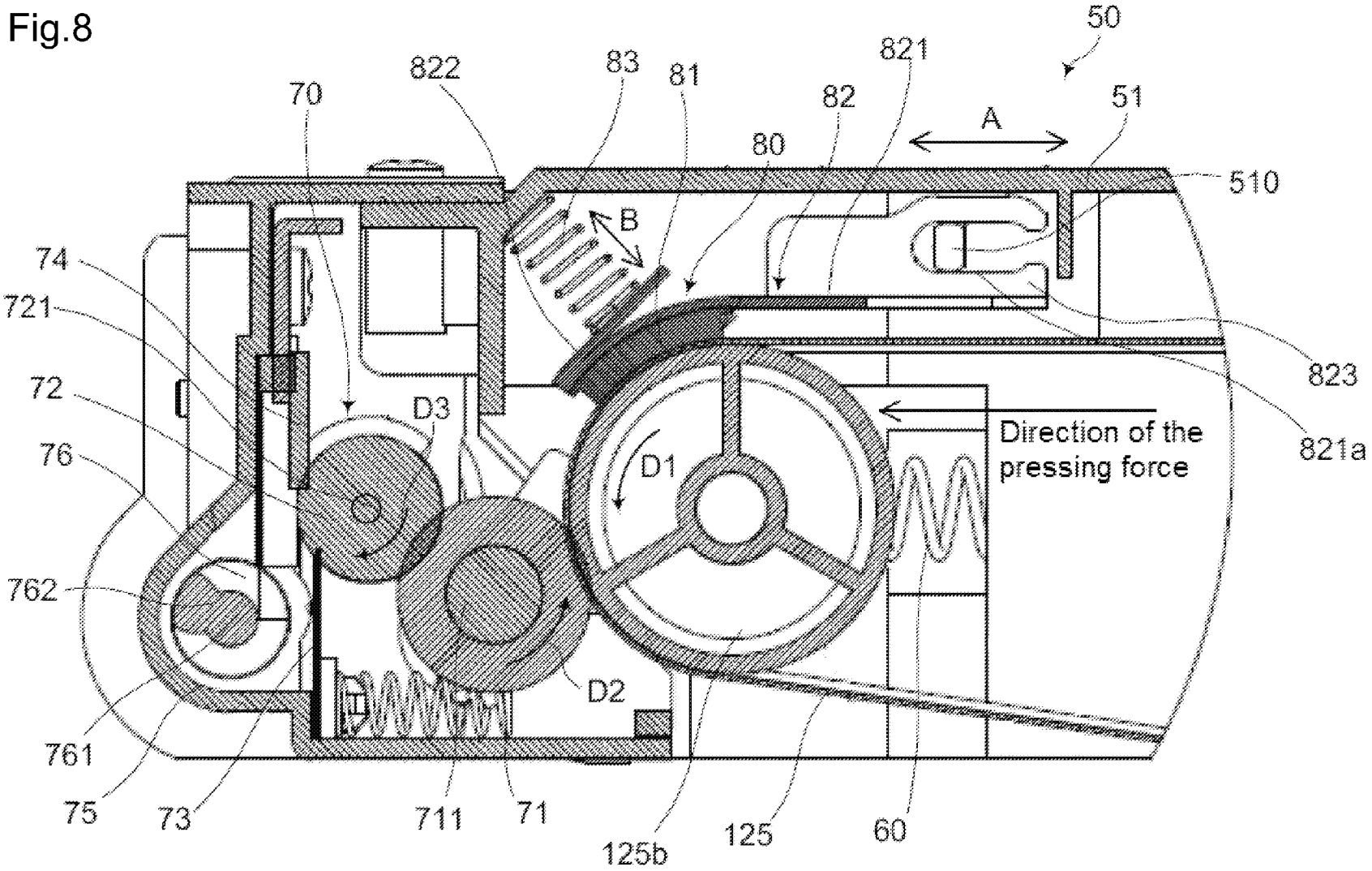
FIG. 8 is a cross-sectional side view illustrating the mechanisms around the driven roller in the intermediate transfer unit.

Next, removal of the remnant toner by the brush unit 80 and the cleaning device 70 will be described with reference to new FIG. 6 to FIG. 8 in addition to FIG. 5. FIG. 6 to FIG. 8 are cross-sectional side views illustrating the mechanisms around the driven roller 125*b* in the intermediate transfer unit 50. FIG. 6 illustrates a state where the brush member 81 and the supporting member 82 have moved from the state illustrated in FIG. 5 to a direction approaching the outer circumferential surface of the intermediate transfer belt 125. FIG. 7 illustrates a state where the brush member 81 and the supporting member 82 have moved to the direction of the pressing force by the pressing spring 60. FIG. 8 illustrates a state where the brush member 81 and the supporting member 82 have moved to the inverse direction of the direction of the pressing force by the pressing spring 60.

As described above, the toner images are transferred on the outer circumferential surface of the intermediate transfer belt 125 by the respective image forming units 12M to 12Bk. The toner images are then transferred on the recording sheet P conveyed to the nip portion N at the nip portion N between the drive roller 125*a* via the intermediate transfer belt 125 and the secondary transfer roller 210 by the secondary transfer roller 210.

After this secondary transfer, the remnant toner remaining on the outer circumferential surface of the intermediate transfer belt 125 is conveyed to the driven roller 125*b* by the intermediate transfer belt 125. Thus, the remnant toner reaches to positions where the brush unit 80 and the cleaning device 70 illustrated in FIG. 5 are located.

At this time, the remnant toner on the outer circumferential surface of the intermediate transfer belt 125 contacts the brush member 81 of the brush unit 80, first. As described above, since the brush member 81 is pressed to the outer circumferential surface of the intermediate transfer belt 125 part stretched by the driven roller 125*b* by the pressing member 83. Accordingly, the brush member 81 contacts the remnant toner on the outer circumferential surface and generates friction, thus electric charges are imparted to the remnant toner.

The remnant toner with the electric charges imparted approaches the contact part with the fur brush 71 of the cleaning device 70 in association with running of the intermediate transfer belt 125. The remnant toner is electrostatically adsorbed to the fur brush 71 and then move to the fur brush 71 side. The remnant toner is recovered in the toner storage unit 75 by the recovery roller 72 and the cleaning blade 74.

The following case is assumed here: the brush member 81 is thinned due to abrasion by sliding contact with the intermediate transfer belt 125 or a similar cause, collapsed bristles, or a similar cause; or the position of the driven roller 125*b* when the intermediate transfer unit 50 is installed to the apparatus main body 11 changes from the previous position to the direction of contact/separation with respect to the brush member 81. In these cases, a pressing force is applied to the supporting member 82, which holds the brush member 81, to the direction heading for the outer circumferential surface of the intermediate transfer belt 125 by the pressing member 83, and the opening 821*a* clasps the protrusion 510. Accordingly, the supporting member 82 turns to the outer circumferential surface of the intermediate transfer belt 125 around the protrusion 510 as the turning pivot. Thus, the state of the brush member 81 contacting the outer circumferential surface of the intermediate transfer belt 125 is held. Thus, a state of turning the supporting member 82 and the brush member 81 is illustrated in FIG. 6. At this time, a pressing force by the pressing member 83 causes the brush member 81 to be pressed against the outer circumferential surface of the intermediate transfer belt 125 at a pressing force similar to the force in the state illustrated in FIG. 5. The brush member 81 is pressed against the outer circumferential surface of the intermediate transfer belt 125 part stretched by the driven roller 125*b*, that is, the outer circumferential surface of the intermediate transfer belt 125 whose inner circumferential surface is supported by the driven roller 125*b*. Accordingly, the pressing force by the pressing member 83 can be efficiently transmitted to the intermediate transfer belt 125.

As illustrated in FIG. 7, assume the case where the driven roller 125*b* moves to the direction of the pressing force by the pressing spring 60, namely, the direction approaching the cleaning device 70, which is caused by pressing force by the pressing spring 60 or a similar cause, compared with the previous position. In this case, the opening 821*a* of the supporting member 82 extends in the direction of the pressing force of the pressing spring 60 and has a void at the side of the movement direction of the driven roller 125*b* with respect to the protrusion 510. Accordingly, the supporting member 82 and the brush member 81 move to the same direction together with the driven roller 125*b* and the intermediate transfer belt 125 part stretched by the driven roller 125*b* in association with the movement of the driven roller 125*b*. At this time, the pressing force by the pressing member 83 and elastic force by the pressing spring 60 ensure pressing the brush member 81 to the outer circumferential surface of the intermediate transfer belt 125 at the pressing force similar to the force in the state illustrated in FIG. 5.

Thus, even if the driven roller 125*b* moves to the direction of the pressing force by the pressing spring 60, a state where the brush member 81 contacts the outer circumferential surface of the intermediate transfer belt 125 while ensuring constant pressure is held. In this case as well, since the inner circumferential surface of the intermediate transfer belt 125 is supported by the driven roller 125*b*, the pressing force by the pressing member 83 can be maintained so as to be efficiently transmittable to the intermediate transfer belt 125.

As illustrated in FIG. 8, assume the case where the driven roller 125*b* moves due to compression of the pressing spring 60 or a similar cause to the opposite direction of the direction of the pressing force by the pressing spring 60, namely, the direction away from the cleaning device 70, compared with the previous position. In this case, the pressing member 83 shrinks due to its elasticity. Furthermore, the opening 821*a* of the supporting member 82 has a void also at the side of the movement direction of the driven roller 125*b* with respect to the protrusion 510. Accordingly, the supporting member 82 and the brush member 81 move to the same direction together with the driven roller 125*b* and the intermediate transfer belt 125 part stretched by the driven roller 125*b* in association with the movement of the driven roller 125*b*. At this time as well, the pressing force by the pressing member 83 and the elastic force by the pressing spring 60 ensure pressing the brush member 81 against the outer circumferential surface of the intermediate transfer belt 125 at the pressing force similar to the force in the state illustrated in FIG. 5.

Thus, even if the driven roller 125*b* moves to the opposite direction of the direction of the pressing force by the pressing spring 60, the state of the brush member 81 contacting the outer circumferential surface of the intermediate transfer belt 125 is held. In this case as well, since the inner circumferential surface of the intermediate transfer belt 125 is supported by the driven roller 125*b*, the state where the pressing force by the pressing member 83 can be efficiently transmitted to the intermediate transfer belt 125 is maintained.

Thus, with the embodiment, even if the thickness of the brush member 81 is varied, pressing the supporting member 82 and the brush member 81 by the pressing member 83, a state where the brush member 81 contacts the intermediate transfer belt 125 part stretched by the driven roller 125*b* is maintained. Even if the position of the driven roller 125*b* is moved, elasticity of the pressing spring 60 and the slit-shaped opening 821*a* of the supporting member 82 cause the brush member 81 to follow and move in association with the movement. Accordingly, a state where the brush member 81 contacts the recovery surface of the intermediate transfer belt 125 part is maintained, thus keeping the pressing force to the intermediate transfer belt 125 from the brush member 81 constant.

Figure 9:
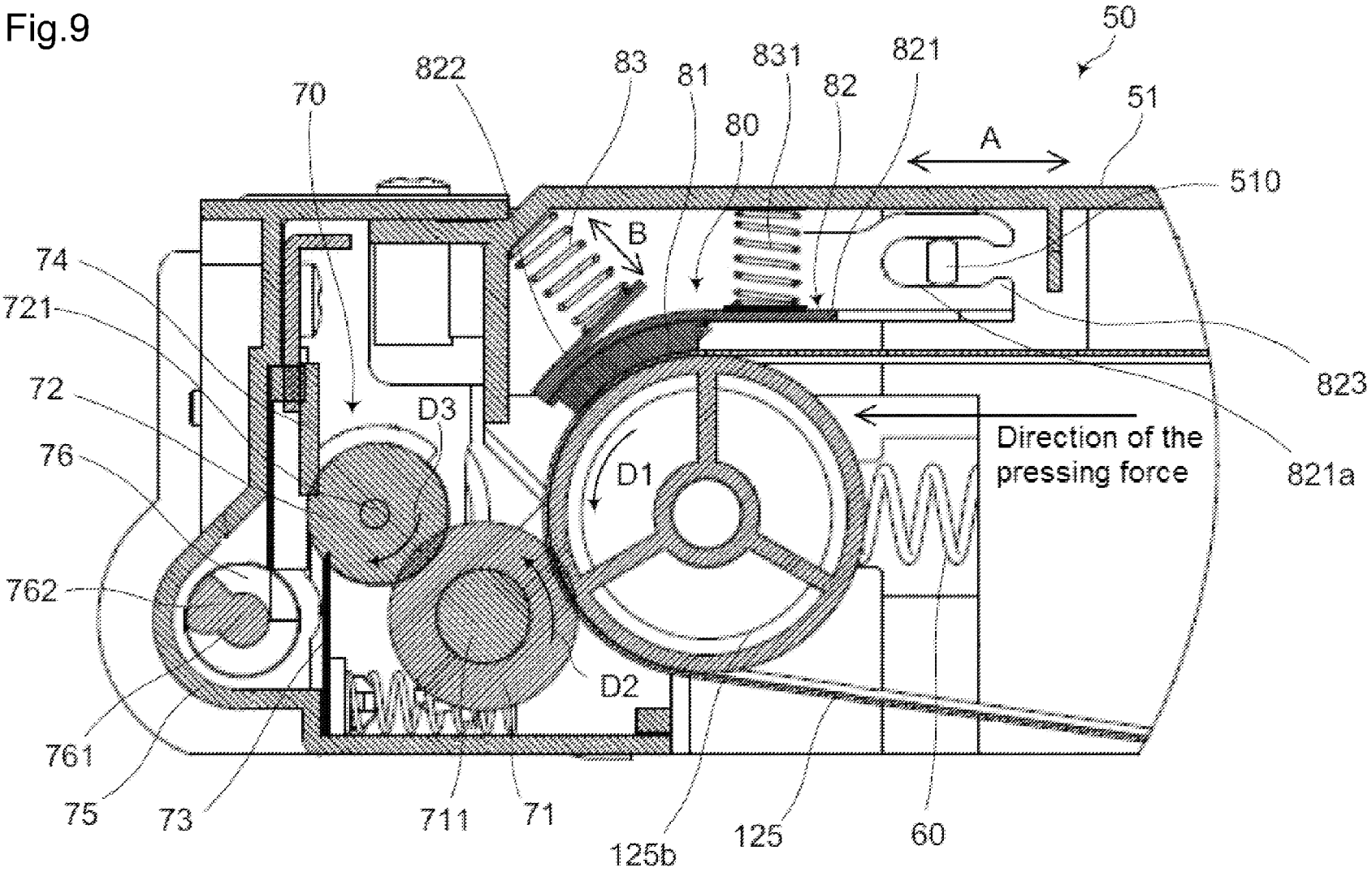
FIG. 9 is a cross-sectional side view illustrating mechanisms around a driven roller in an intermediate transfer unit according to another embodiment.

The disclosure is not limited to the configurations of the embodiments but various modifications are possible. For example, the embodiment shows the supporting member 82 of the brush unit 80 pressed by the one pressing member 83. However, a configuration of pressing the supporting member 82 by a plurality of pressing members is also possible. For example, as illustrated in FIG. 9, one end of a pressing member 831, which is constituted of a pressing spring, may be additionally attached to the upper part of the casing 51 in FIG. 9 to the supporting member 82 while the other end part of the pressing member 831 may be attached to the brush holder unit 821 of the supporting member 82. Accordingly, the brush member 81 is pressed not only from the direction of the pressing force by the pressing member 83 but also the direction of the pressing force by the pressing member 831. This prevents biased transmission of the pressing force from the brush member 81 to a part of the contact region with the outer circumferential surface of the intermediate transfer belt 125. The pressing force transmitted to the brush member 81 can be a resultant force of the pressing members 83 and 831. This achieves more fine adjustment of the direction of the pressing force to the brush member 81.

In the embodiments, as an image forming apparatus according to the disclosure, a multi-functional peripheral is employed as one embodiment; however, this is merely an example. The image forming apparatus may be another type of image forming apparatus such as a printer, a copying machine, and a facsimile machine.

In the embodiment, the configurations and the processes shown in the embodiments with reference to FIG. 1 to FIG. 9 are merely one embodiment of the disclosure. It is not intended to limit the scope of the disclosure to the configurations and the processes.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An intermediate transfer unit, comprising:

an intermediate transfer belt with an outer circumferential surface onto which a toner image is transferred from an image forming unit;

a plurality of rollers around which the intermediate transfer belt is stretched, the plurality of rollers comprising a drive roller and a driven roller, and being configured to cause the intermediate transfer belt to run endlessly in a given direction;

a cleaning unit configured to outer circumferentially contact the intermediate transfer belt in a belt driven-roller contacting area where the belt is in peripheral-surface contact with the driven roller, the cleaning unit being configured to electrostatically adsorb and recover toner remaining on the transfer-belt outer circumferential surface;

a brush unit disposed and configured to outer circumferentially contact/ separate from the intermediate transfer belt in the first belt-contacting area, upstream, in the running direction of the intermediate transfer belt, of the cleaning unit;

a casing in which mechanisms of the intermediate transfer unit are mounted;

an arcuate protrusion provided on the casing in a position to serve as a brush-unit supporting pivot; and a pressing spring configured to press the driven roller in the belt driven-roller contacting area, in a direction imparting tension to the intermediate transfer belt, the driven roller therein stretching the intermediate transfer belt where the belt is outer-circumferentially contacted by the brush unit, the driven roller being pivotally supported in the casing, in a state enabling the driven roller to move in the direction of pressing force by the pressing spring; wherein the brush unit includes a brush member having a curved surface contoured to follow the peripheral surface of the roller in the first belt-contacting area, a supporting member including a brush holder holding the brush member, and a spring mount integral with the brush holder and disposed on a distal end portion thereof, the supporting member having a clasping slit extending along the direction of pressing force by the pressing spring, the supporting member pivotally clasping the arcuate protrusion, a first pressing member, opposite ends of which are mounted respectively on the casing and on the spring mount of the brush-unit supporting member, the first pressing member therein pressing the supporting member to turn the brush member in the direction along which the brush unit outer circumferentially contacts/separates from the intermediate transfer belt, the brush unit therein being configured to impart electric charge to the remnant toner by friction of the brush unit's outer circumferential contact with the intermediate transfer belt, and a second pressing member opposite ends of which are attached respectively to the casing and to the brush-unit supporting member, the second pressing member therein configured to press the supporting member in a direction different from the direction along which the brush unit outer circumferentially contacts/separates from the intermediate transfer belt.

2. An image forming apparatus, comprising:

an image forming unit; and the intermediate transfer unit according to claim 1.

3. An image forming apparatus, comprising:

an image forming unit; and the intermediate transfer unit according to claim 1.

4. In an image forming apparatus including an image forming unit and an intermediate transfer unit, mechanisms of which, including a brush unit, are mounted in a casing, the casing provided with an arcuate protrusion in a position to serve as a brush-unit supporting pivot, an intermediate transfer method, comprising:

transferring a toner image onto an outer circumferential surface of an intermediate transfer belt from the image forming unit;

stretching the intermediate transfer belt around, and running the transfer belt endlessly in a given direction over, a plurality of rollers comprising a drive roller and a driven roller;

electrostatically adsorbing and recovering toner remaining on the transfer-belt outer circumferential surface, by outer circumferentially contacting a cleaning unit on the intermediate transfer in a belt driven-roller contacting area where the belt is in peripheral-surface contact with the driven roller;

a process of imparting electric charge to the remnant toner by friction of the brush unit's contact outer circumferentially on the intermediate transfer belt, the brush unit being disposed and configured to outer circumferentially contact/separate from the intermediate transfer belt in the first belt-contacting area, upstream, in the running direction of the intermediate transfer belt, of the cleaning unit, pressing the driven roller in the belt driven-roller contacting area with a pressing spring, in a direction imparting tension to the intermediate transfer belt, the driven roller therein stretching the intermediate transfer belt where the belt is outer-circumferentially contacted by the brush unit;

pivotally supporting, in the casing, the driven roller, in a state enabling the driven roller to move in the direction of pressing force by the pressing spring; wherein the brush unit includes a brush member having a curved surface contoured to follow the peripheral surface of the roller in the first belt-contacting area, a supporting member including a brush holder holding the brush member, and a spring mount integral with the brush holder and disposed on a distal end portion thereof, the supporting member having a clasping slit extending along the direction of pressing force by the pressing spring, the supporting member pivotally clasping the arcuate protrusion, and a first pressing member, opposite ends of which are mounted respectively on the casing and on the spring mount of the brush-unit supporting member;

pressing the supporting member with the first pressing member to turn the brush member in the direction along which the brush unit outer circumferentially contacts/separates from the intermediate transfer belt; the process of imparting electric charge to the remnant toner therein including contacting the brush member on the intermediate transfer belt in the first belt-contacting area; and pressing the brush-unit supporting member in a direction different from the direction along which the brush unit outer circumferentially contacts/separates from the intermediate transfer belt.

5. An image forming method, comprising:

forming an image; and performing the intermediate transfer method according to claim 4.

* * * * *